United States Patent [19]

Kulig

[11] 4,406,365

[45] Sep. 27, 1983

[54] BASKET TYPE BOTTLE CARRIER

[75] Inventor: Francis V. Kulig, Morris, Ill.

[73] Assignee: Federal Paper Board Co., Inc., Montvale, N.J.

[21] Appl. No.: 301,470

[22] Filed: Sep. 14, 1981

[51] Int. Cl.[3] ..... B65D 6/16; B65D 5/48

[52] U.S. Cl. ..... 206/188; 206/141; 206/143; 206/175; 206/181; 206/187; 206/193; 206/194; 206/198; 229/44 CB

[58] Field of Search ..... 206/139-143, 206/181, 188, 175, 185, 187, 190, 191, 198; 229/28 BC, 44 CB

[56] References Cited

U.S. PATENT DOCUMENTS

| | | | |
|---|---|---|---|
| 3,084,831 | 4/1963 | Arneson | 206/191 |
| 3,104,027 | 9/1963 | Kulig | 206/190 X |
| 3,266,663 | 8/1966 | Ringler | 206/180 X |
| 3,917,060 | 11/1975 | Wood | 206/187 |
| 4,010,847 | 3/1977 | Wood et al. | 206/187 |

*Primary Examiner*—Steven M. Pollard
*Assistant Examiner*—Bryon Gehman
*Attorney, Agent, or Firm*—FitzGibbon, Roehrig, Greenawalt & Stone

[57] ABSTRACT

A collapsible carrier for bottled beverages which is formed from a blank of paperboard or similar material, cut and creased so that it may be folded and glued to establish, when set up, a bottom, upstanding side and end walls, and a handle and partition structure which includes a longitudinal center partition and three cross partitions on opposite sides thereof to divide the carrier into eight bottle receiving cells with the cross partitions providing two plies of blank material between points of bottle contact and with the center partition providing two plies of material between transverse pairs of bottles.

10 Claims, 17 Drawing Figures

BASKET TYPE BOTTLE CARRIER

BACKGROUND OF THE INVENTION

This invention relates to cellular basket type carrier packaging for beverage bottles or similar bottle products and more specifically, relates to a carrier fabricated from a single blank of sheet material, with the blank being cut and creased to divide the same into a plurality of panels, which are folded into predetermined relation to provide twin compartments separated by a longitudinally extending center partition, with each compartment subdivided into a multiplicity of article accommodating cells by cross partitions extending in longitudinally spaced relation between the center partition structure and the oppositely disposed side walls of the carrier.

Cellular bottle carriers have heretofore been designed for use in connection with the marketing of bottled beverages, such as soft drinks, beer and the like. Such cellular carriers have been fabricated from lightweight, paperboard stock, so as to keep the cost sufficiently low to make it practical to employ them for single trip use, for example, with disposable glass bottles now commonly marketed. Carriers of this general type are disclosed in U.S. Pat. Nos. 3,104,027; 3,400,856 and 4,144,966. These carriers are adapted to be fabricated from a paperboard of relative lightweight, and are so constructed that the bottles in the individual cells are separated by a thickness of material required to meet applicable railroad shipping regulations and permit the use of the carriers in the marketing of beer when this beverage is likely to be shipped by rail. In prior art carriers relatively heavier material is generally employed to package more than six beverage bottles to meet the necessary requirements dictated by the shipping regulations of the railroads. However, the use of such heavy duty material increases the overall cost of the packaging and does not permit the use of a lightweight board material, which is desirable for reasons of both economy and ease of manufacture.

It is therefore a general object of the invention to provide an improved bottle carrier, which is fabricated from a single sheet, or blank, of relatively lightweight material, flexible paperboard, or similar material, with the blank being cut, scored, and folded in a novel manner so as to provide bottle separating partitions, which in the erected carrier, have a double thickness of material at the contact points between the bottles.

It is a more specific object of the invention to provide an improved paperboard article carrier fabricated from a paperboard blank of minimum size which is slit, creased and folded to provide oppositely disposed side walls, a longitudinal partition and handle structure paralleling the side walls, and a plurality of cross partition members, which are derived from end portions of the longitudinal partition panels and which extend between the latter and the side walls, when the carrier is in an erected condition with the cross portions folded upon each other, so as to provide a double thickness between the articles of adjoining cells. The longitudinal partition structure includes panel portions in the areas between the cells on the opposite sides thereof which also provides a double thickness of material for separating the articles.

It is a further object of the invention to provide a twin compartment, multi-cellular collapsible bottle carrier formed from an approximate rectangular sheet of paperboard of relatively lightweight, which is cut and scored to provide a bottom wall forming panel, side wall forming panels hinged to opposite side edges thereof, pairs of end wall and longitudinal partition reinforcing panels which are cut from the material at the side of the blank and folded to provide a double thickness of material between bottles in adjacent cells.

It is a further object of the invention to provide a twin compartment, multi-cellular bottle carrying employing cross partition members having an upper curved configuration at their upper edge to facilitate insertion of the bottles in each respective cell by inducing a sliding action thereof during such insertion.

These and other objects and advantages of the invention will become more apparent when reference is made to the accompanying detailed description of the preferred embodiments of the invention which are shown by illustration in the accompanying drawings, wherein like reference numerals indicate corresponding parts throughout.

DESCRIPTION OF THE PREFERRED EMBODIMENTS

Figure 1:
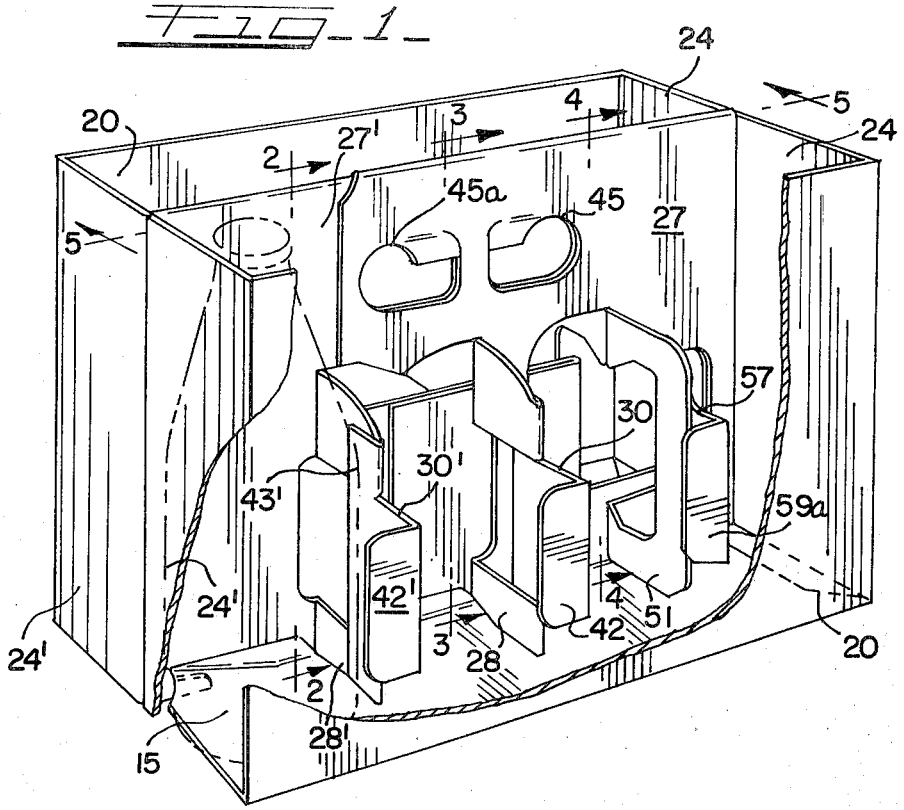
FIG. 1 is a perspective view of one embodiment of an article carrier having embodied therein the principal features of the invention, with the carrier being shown in set-up, empty condition and with portions of the side wall and adjoining end wall broken away.
Figure 2:
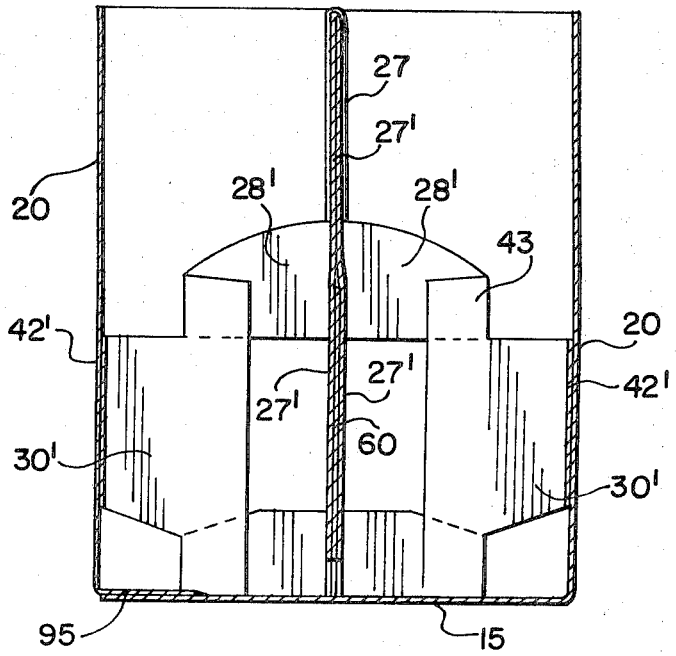
FIG. 2 is a horizontal cross sectional view taken along lines 2—2 of FIG. 1.
Figure 5:
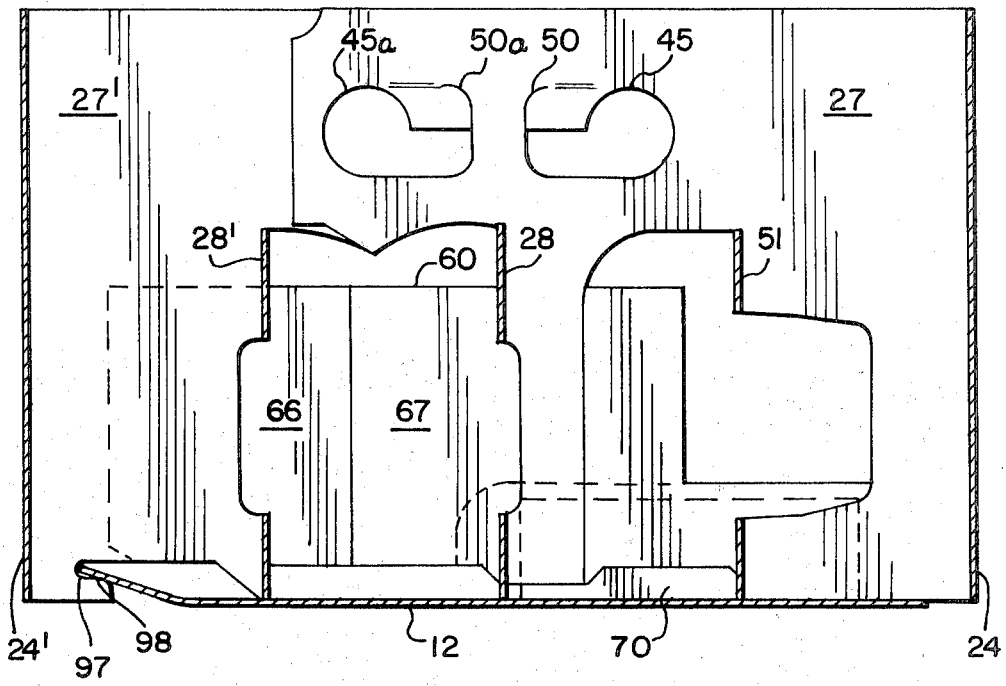
FIG. 5 is a longitudinal vertical section taken along the lines 5—5 of FIG. 1.
Figure 3:
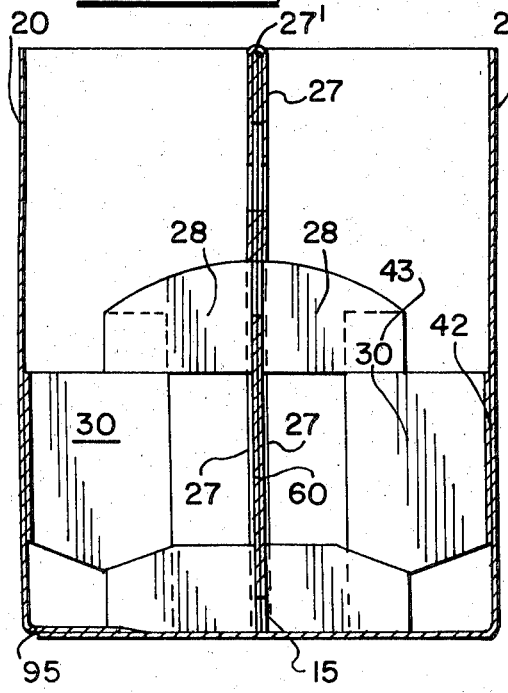
FIG. 3 is an additional horizontal cross section taken along the lines 3—3 of FIG. 1.
Figure 4:
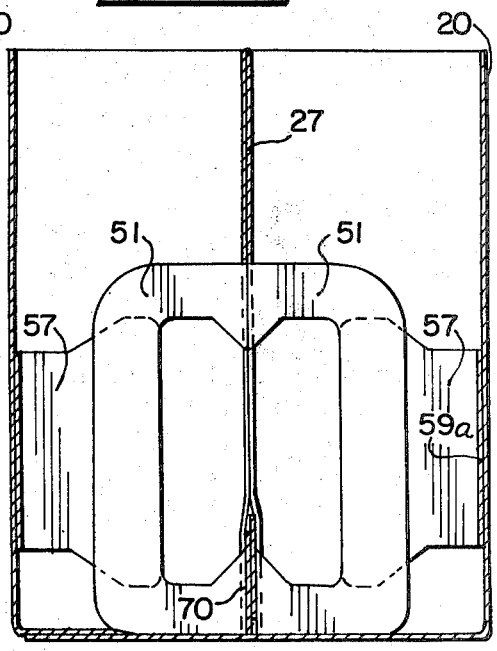
FIG. 4 is still another horizontal cross section taken along the lines 4—4 of FIG. 1.
Figure 6:
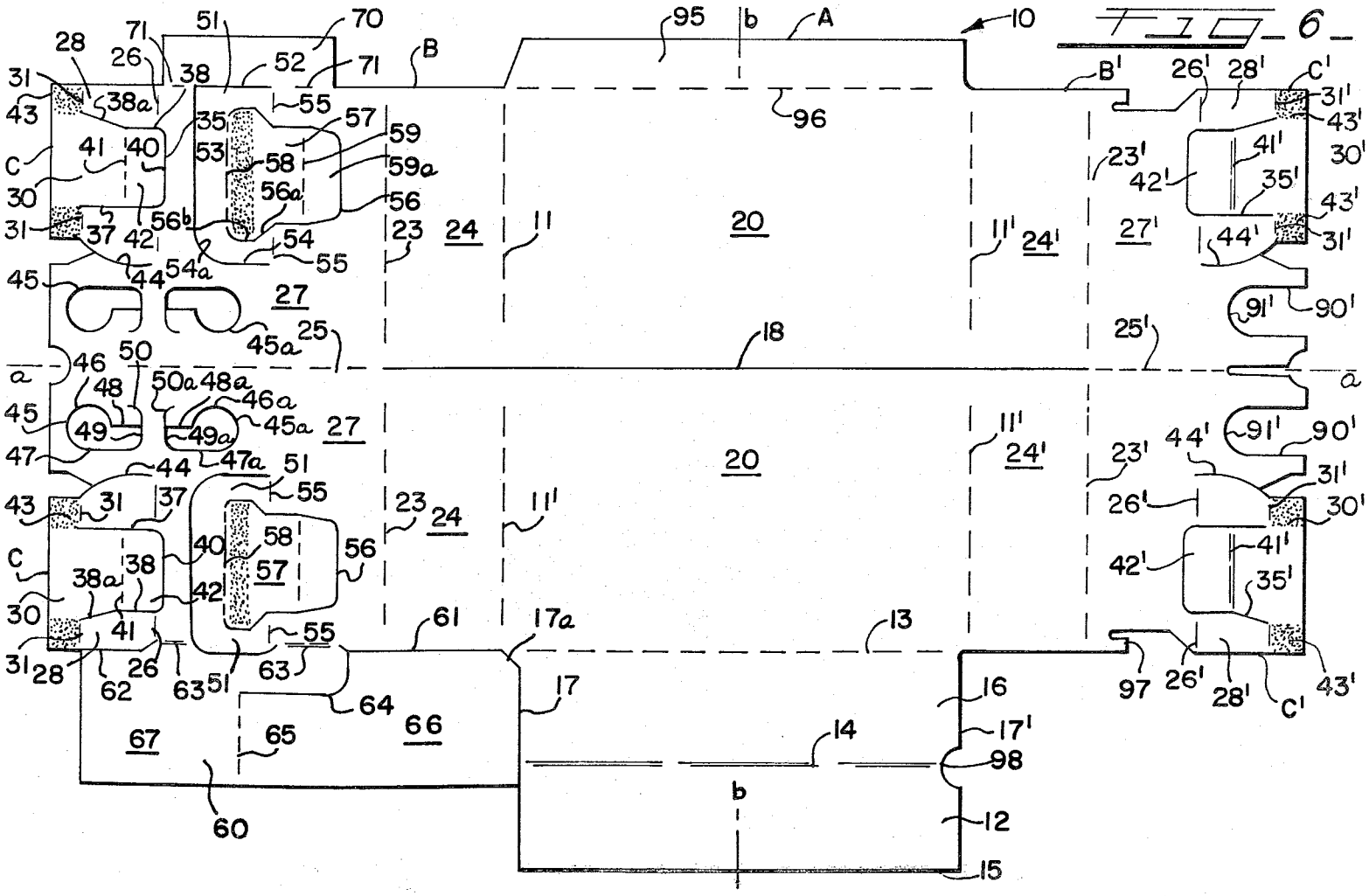
FIG. 6 is a plan view of a paperboard blank which is cut and scored for fabricating the carrier of the embodiment of the invention of FIG. 1, with certain areas having adhesive thereon.

Referring first to FIGS. 1 through 14 of the drawings, there is illustrated a first embodiment of a carrier carton (FIG. 1) fabricated from a blank of material 10 which is cut and scored as shown in FIG. 6. The carton of FIG. 1 is adapted to be filled with a plurality of beverage bottles, such as eight in a number, which are arranged in a four in a row relation on each side of a central partition and handle structure. Blank 10 comprises a single, one-piece blank (FIG. 6) of flexible papersheet material which is of generally rectangular outline and which may be relatively thin, for example, having a thickness of 0.020 inches, commonly referred to as 20 point paperboard stock. The carton embodying the principles of the invention is capable of compliance with all applicable railroad regulations and attains a full 40 point of paperboard separation between the bottles, such as is required in transporting 12 ounce bottles and the like, when using 20 point stock. The carrier herein disclosed also achieves 0.36 to 0.38 separation, using proportionally thinner board, such as permissible in accordance with railroad rules with the use of certain bottles, such as having a seven ounce capacity. The carrier illustrated with reference to FIGS. 1 to 14 employs high side walls and end walls to prevent cartons, containing bottles of beer, from being exposed to light when in a stacked position as often required by the beer industry. The blank 10 is cut and scored so as to divide it into the wall and partition forming panels, which are thereafter folded and secured together to form the upwardly and opening tray-like, cellular basket carrier of FIG. 1.

For convenience of illustration, the cut and scored blank 10 will be described in relation to longitudinal and transverse lines a—a and b—b, respectively, which lines correspond to longitudinal and transverse center lines of a set-up carrier. Corresponding elements of the blank, which are found on opposite sides of the longitudinal line a—a, will be designated by the same reference numerals, and where an element found on one side of transverse line b—b has a counterpart or similar element on the other side thereof, it will be designated by the same reference numeral primed.

Blank 10 is divided in the longitudinal direction into three sections with a center section A and two end sections B and B'. The end section B' has approximately three-fourths the dimension of section B in the longitudinal direction of the blank of FIG. 6. The center section A is subdivided to provide the carrier bottom wall and the side walls, and the two end sections B and B' are so provided to form the carrier end walls and a combination partition and handle structure. The center section A is separated from the end sections B and B' by transversely extending score lines 11 and 11', and the main body of the center section A is separated from a bottom wall forming panel 12 by a longitudinally extending score line 13. The bottom wall forming panel 12 is subdivided by longitudinally extending score line 14, which is parallel with and spaced outboard from the score line 13, to divide the panel into two halves 15 and 16, which are adapted to fold upon each other on the line 14 in collapsing the carrier. The bottom forming panel 12 is separated from an adjoining side extension of the blank section B by a transverse cutting line 17 which projects outwardly from the end of score line 11, in off-set longitudinal relationship thereto, in the direction of transverse line b—b with a short angled, cutting line 17*a* extending from hinge line 11 to cutting line 17. The bottom forming panel 12 further includes an opposite cutting line 17', at the other end of panel 12, which is similarly longitudinally off-set from score line 11 in an inward direction toward transverse line b—b.

The main portion of the center section A of the blank is divided by cutting line 18, which is parallel to the score line 13 and substantially corresponds to the longitudinal reference line a—a of the blank. The cutting line 18 extends into the blank sections B, B' equal distances from the transverse line b—b and terminates at transverse score lines 23, 23' in the blank sections B and B'. The score lines 23 and 23' are spaced from the parallel score lines 11 and 11' at a distance equal to half the width of the carrier, when set-up, and these lines define the edges of end forming wall panels 24, 24'. The blank end sections B and B' are divided by longitudinally extending score line 25 and 25' of respective differing lengths, which coincide with the longitudinal line a—a and which score lines 25 and 25' are preferably weakened by perforating or slitting so as to facilitate subsequent folding operations. The score lines 25 and 25', together with score lines 23, 23' define four corner sections, C, C and C', C', which are further subdivided so as to provide longitudinal partition and handle forming panels and cross partition panels.

Each of the corner sections C, C on one side of transverse line b—b is subdivided by parallel longitudinally spaced score lines 26, 26 to provide longitudinal partition and handle forming panels 27, 27 which adjoin the end forming panels 24, 24 and cross partition panels 28, 28. The cross partition panels 28, 28 at the two corners of the blank are cut and scored in the identical manner to provide cross partition members 30, 30 which hinge on score lines 31, 31 in forming the cross partition structure. Panels 28, from which the member 30 is taken on each side of the longitudinally extending line a—a in corner section C, are cut on a generally U-shaped line 35, comprising spaced parallel portions 37, 38, with an end section 38*a* of portion 38 deviating outward in an angle relationship thereto, and a base portion 40 which extends slightly into panel 27. The portions of the panel defined by the U-shaped cutting lines are subdivided by transversely aligned score lines 41 which are spaced intermediate the hinge forming score lines 26 and 31, so as to define glue tabs 42. The score line 31 is parallel with the score lines 26 and extends from the ends of the U-shaped cutting line 35 to the top and bottom forming edges of the panels 28. The score lines 31 form hinge lines enabling the swinging of the marginal strip portions 43 about the lines 31, in a 180° arc, so as to bring the marginal strip portion into face to face contact with the main portion of the panels 28 as hereinafter described. The panel 28 in one corner section C is cut away from panel 27 by cutting line 44, while the panel 28 in the opposite section C is cut in away in part by cutting line 44.

Two pairs of finger forming holes 45 and 45*a* are longitudinally spaced in symmetrical relationship in panels 27, 27 equal distance from the longitudinal center line a—a. Each of the cutting holes 45, 45*a* are respectively formed by curved cutting lines 46, 46*a*, parallel longitudinal cutting lines 47, 48 and 47*a*, 48*a*, and transverse cutting lines 49, 49*a*, having a slightly curved corner portion adjacent cutting lines 47, 47*a*. A cutting line 50, 50*a*, extending from the intersection of cutting lines 48, 48*a* and 49, 49*a*, provides a reinforcing flap adjacent the finger holes. Each pair of finger holes 44, 44*a* on each side of the longitudinal lines a—a fold into alignment with the opposite pair to form finger holes of the erected carrier.

The panels 27, 27 are further subdivided in an area disposed between the panels 28 and the lateral fold line 23 to provide additional cross partition forming panels 51 for enabling eight cells to be formed within the carrier. The partition panels 51 are positioned to extend transversely adjacent end walls 24, 24 in the erected carrier. Each one of the cross forming panels, 51, 51 are cut away from panels 27, 27 by a modified U-shaped cutting line comprising a longitudinal portion 52 in alignment with edges of section B and in parallel relation to fold line 25, a base portion 53 extending inwardly toward line a—a in parallel relation to fold lines 23, 11, a second longitudinal portion 54 parallel to portion 52, and a curved cutting portion 54*a* interconnecting two ends of portions 53 and 54. Each of the portions 52 and 54 of the cutting line terminate in alignment with transverse score lines 55, which are parallel to fold lines 23 and 26 at the approximate midpoint therebetween. Each of the panels 51, 51 are cut by a modified U-shaped cutting line 56, 56 to form cross partition forming members 57 which hinge relative to panel 51 about score line 58. Whereas score lines 31 form vertical hinge lines for swinging members 30, which are at a point greater than center and disposed on the outer side of the vertical center line of the associated folded cross partition 28, 30, the score lines 58 are located less than center and are disposed on the inner side of the vertical center line of the folded cross partition 51, 57. The leg portions of cutting line 56 respectively include an end portion having a segment 56*a* angularly diverging adjacent the end segments 56*b* which terminate at the ends of the score line 58. Additional transverse score lines 59 are provided in cross partition forming members 57 so as to provide glue tab forming portion 59*a* at the free end thereof for connecting the members 57 to side walls 20 when the blank 10 is folded.

A longitudinal partition panel 60 extends at one side of one corner section C and is cut free of the bottom forming panel 12 on the cutting lines 17, 17*a*. The panel 60 is separated from the end wall panel 24 and the cross partition panel 28 by longitudinally extending cutting lines 61, 62 with longitudinally spaced score lines 63 connecting the latter and forming an integral hinge connection between the panels 60 and the bottom forming edge of the longitudinal partition 27. The longitudinal partition 60 is divided by cutting line 64 and score line 65 forming two sections 66 and 67 which are adapted to be folded upon each other about the hinge forming line 65 as hereinafter described. The transverse score line 65 is located at a position so that the dimension of the blank panel portion 66, in the longitudinal direction of the blank, is somewhat greater than the dimension of the panel 67. An additional longitudinal partition tab member 70 projects from the opposite edge of section B than partition panel 60 and extends from a point within panel 27. The tab member 70 is hinged on longitudinally extending score lines 71 and is cut from panel 51 by cutting line 52.

The corner panels C′ include respective cross partition forming panels 28′, 28′ which are formed by score lines 26′ and 26′ from panels 27′, 27′. Since the cross partition structure within sections C′, C′ are identical, only one of these will be described in detail. It should also be apparent that the cross partition forming panels 28′, 28′ and associated components, correspond to panels 28, 28 in section C, such that only a general description of panels 28′, 28′ is now needed for an understanding of the invention. It is intended that the partition forming panels 28′, 28′ be adjacent one end wall, of an erected carton, while panels 28, 28 form the center transverse cell partition. The panel 28′, from which the cross partition member 30′ is taken, is generally cut on a U-shaped line 35′ in which a portion of said generally U-shaped cutting line 35′ projects outwardly toward a corner of corner section C′. Portions of the member 30′ defined by U-shaped cutting line 35′ and hinged about score line 31′ are subdivided by transversely aligned score line 41′ which is spaced intermediate the hinge lines 26′ and 31′, so as to define glue tabs 42′. The score lines 31′ form hinge lines enabling the swinging of the marginal strip portion 43′ so as to bring the strip formation in face to face contact with the main portion of the panel 28′ as hereinafter described. The partition forming panels 28′ are cut away from panel 27′ by cutting line 44′ to enable panels 28′ to hinge about score line 26′. The corner sections C′, C′ adjacent to each side of fold line 25′ include handle reinforcing slots formed by spaced parallel cutting lines 90′, 90′ and curved cutting line 91′. Curved cutting lines 91′ coincides with the curved portion of finger holes 45, and 45*a* formed in longitudinal panel 27, when folded between the adjacent pairs of finger holes 45, 45*a* in a set up configuration of the carrier. It should be further noted that a glue flap 95 is provided on the other side of the blank 10 from bottom panel 12 and is separated from the adjoining side wall by score line 96.

Figure 7:
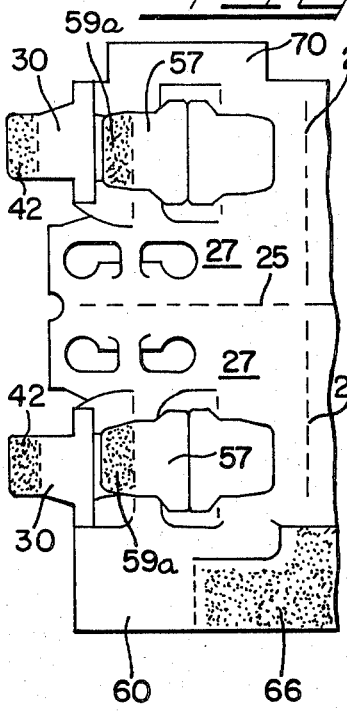
FIG. 7 is a plan view, with parts broken away, of the blank of FIG. 6 following the first folding and subsequent adhesive operations.
Figure 8:
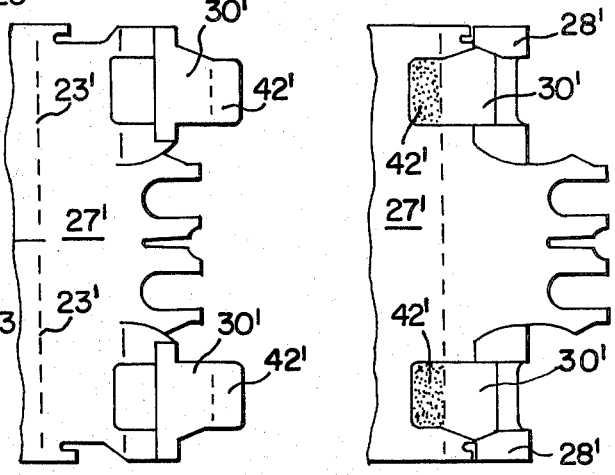
FIG. 8 is a plan view with parts broken away, showing the blank at a further stage of the adhesive applying folding thereof.
Figure 9:
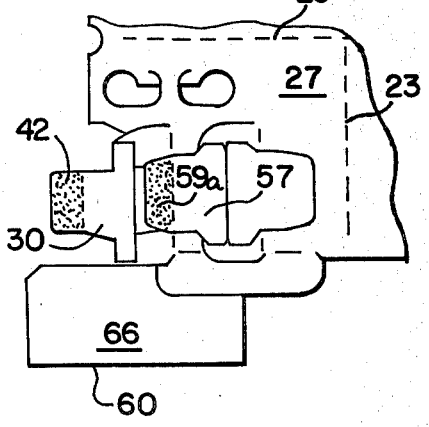
FIG. 9 is a plan view, with parts broken away, showing the blank at a further stage of adhesive applying and folding thereof.
Figure 10:
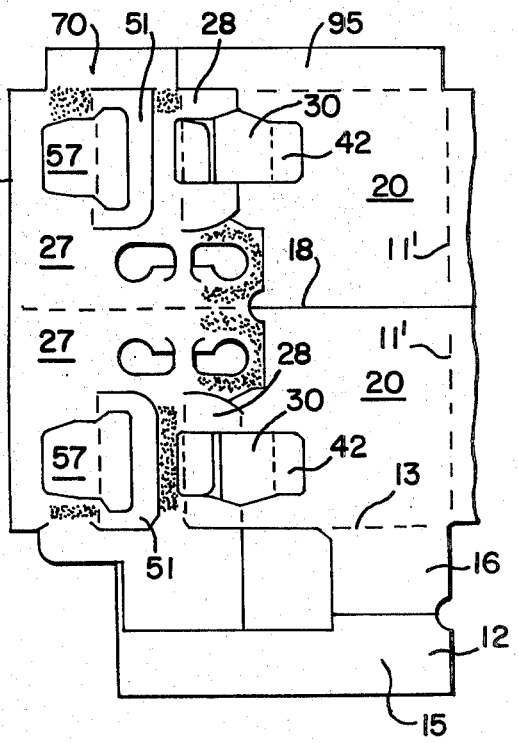
FIGS. 10, 11 and 12 are plan views, aways, illustrating successive further operations of folding the partition panels with adhesive applying, in position for final assembly.

The blank 10 is cut, scored, and glued, as shown in FIG. 5, and then folded to provide the carrier which is illustrated in FIG. 1. A suitable adhesive is applied to the panels where required with application being made to permit proper folding in the required sequence. The panels 28, 28, and 28′, 28′ have an adhesive applied in the areas of portions 43, 43 and 43′, 43′ as shown in FIG. 6. In addition, the cross-partition members 57, 57 have an adhesive applied to the portions shown in FIG. 6. The panel members 30, 30 and 57, 57 are then folded 180° about the hinge lines 31, 31 and 58, 58 in respective opposite directions. The panels 28′, 28′ in corner sections C′, C′ are also folded 180° about hinge lines 26′, 26′ to assume the configuration as shown in FIG. 8, and an adhesive is applied to glue tabs 42, 42′, 59*a*, 59*a′* and 42′, 42′ as in FIGS. 7 and 8. An adhesive is also applied to the portion of panel 66 which is depicted in FIG. 7. In FIG. 9 the panel 66 is then folded on score line 65 in face to face contact with adjoining panel 67. Thereafter, the panels 27, 27 are folded down finally about hinge line 23 to bring the panels into the position in overlying relation with the side walls 20, 20. An adhesive is then applied to a plurality of portions of panels 27, 27 and to the border of section 15 of bottom panel 12. Subsequently, the panels 27′, 27′ are folded about score line 11′ to the configuration of FIG. 12 in overlying relationship with the previously folded panels and an adhesive is applied to one of the panels 27′. Longitudinal partition tab member 70 and panel 60 is folded about score lines 71 and 63, respectively to assume the position shown in FIG. 12, with the panels engaging adhesive portions of panels 27′, 27′. The panels are folded, finally, about the score lines 25, 25′ to bring the panels into the position shown in FIG. 13, and the bottom wall forming panel 15 and 16 are folded on the line 14 so as to complete the fabrication of the carrier in the collapsed or knocked down condition as shown in FIG. 14.

Figure 14:
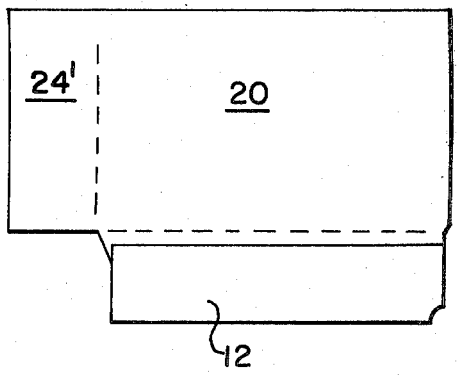
FIG. 14 is a plan view of a completed carrier in the flat knockdown position.

The collapsed carrier is opened up for filling and use by applying pressure to the opposite ends as shown in FIG. 14. The bottom wall forming panels will unfold and the cross partition panels will move into the position shown in FIG. 1. A hook formation 97 is provided on the bottom edge of the center partition structure for engagement with the end edge of the bottom wall 15, 16, at the recess 98, for holding the carrier in an erected condition.

Figure 15:
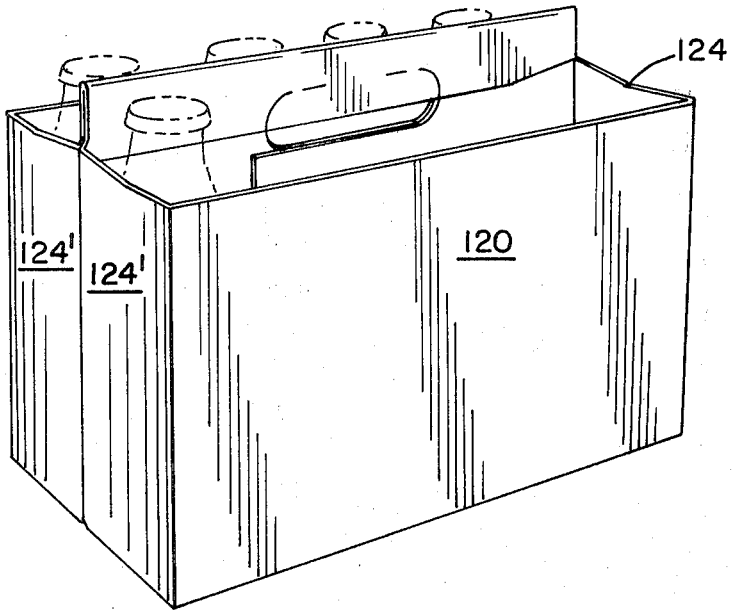
FIG. 15 is a perspective view of another embodiment of the article carrier having embodied therein the principal features of the invention, the carrier being shown in set-up, empty condition.
Figure 16:
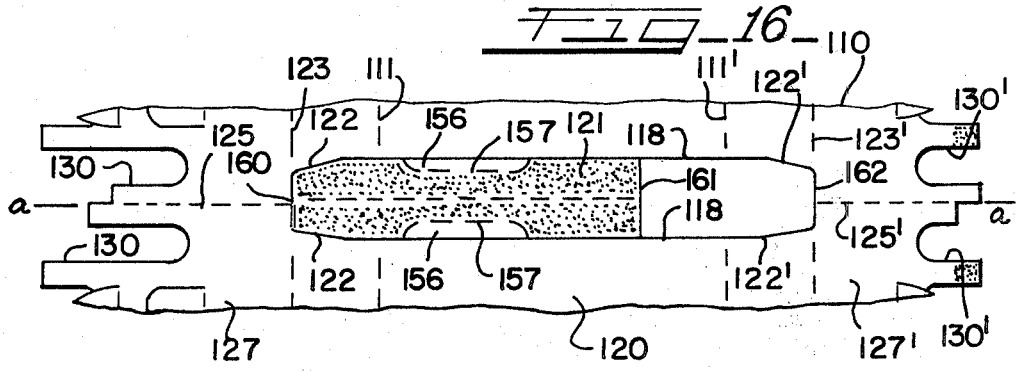
FIG. 16 is a partial top plan view of the handle cover panel of the paperboard blank, which is cut and scored for fabricating the carrier of FIG. 15.
Figure 17:
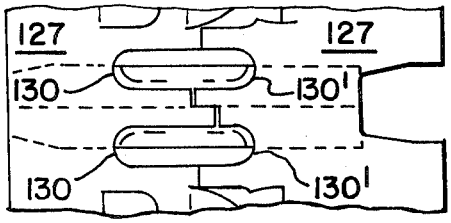
FIG. 17 is a plan view of sections of the panels adjacent to the handle cover panel being folded in successive folds to form the reinforced handle of the carrier of FIG. 15.

Referring now to FIGS. 15 to 17 there is illustrated another embodiment of a carrier (FIG. 15) made in accordance with principles of the invention. The carrier is fabricated from a blank 110 of paperboard material which is scored and fabricated in a similar manner as blank 10 of FIG. 6 with the exception of the portion of the blank 110 shown in FIG. 16. Components of blank 110, which correspond to similar parts of blank 10, are designated by the same reference numeral, but as three digit numbers. Essentially, the carrier of FIG. 15 includes a modified handle structure which extend above side walls 120, 120 and end walls 124, 124' in an erected carrier.

As shown in FIG. 16, the finger holes 45, 45, 45*a*, 45*a* and slots 90', 90', as in the blank of FIG. 6 have been eliminated and replaced by a modified handle forming panel. The main portion of the center section A of the blank 110 is divided by a pair of transverse cutting lines 118 which are spaced on opposite sides of line a—a to provide two side wall forming panels 120 and a portion of a handle cover panel 121. The cutting lines 118 extend at portions 122 and 122' into the blank sections B and B' equal distances from the line b—b and terminate at transverse score lines 123 and 123'. The score lines 123 and 123' are spaced from the parallel score lines 111 and 111' a distance equal to half the width of the carrier when set up and these lines define the edges of end wall panels 124 and 124'. The blank end sections B and B' are divided by longitudinally extending score lines 125 and 125' which coincide with the longitudinal line a—a and which are preferably weakened by a perforating or slitting operation so as to facilitate subsequent folding operations. The score lines 125 and 125' together with score lines 123 and 123' define four corner sections C, C and C', C' (part of which are shown in FIG. 16) which are further subdivided in an identical manner (not shown) as blank 10 to form longitudinal and cross partitions described with reference to the first embodiment of FIGS. 1 to 14. It should be noted that the blank 110 further includes cutting lines 130, 130 and 130', 130' to form portions of hand holes in handle forming sections at the top of the longitudinal partition structure as illustrated in FIG. 15.

Figure 11:
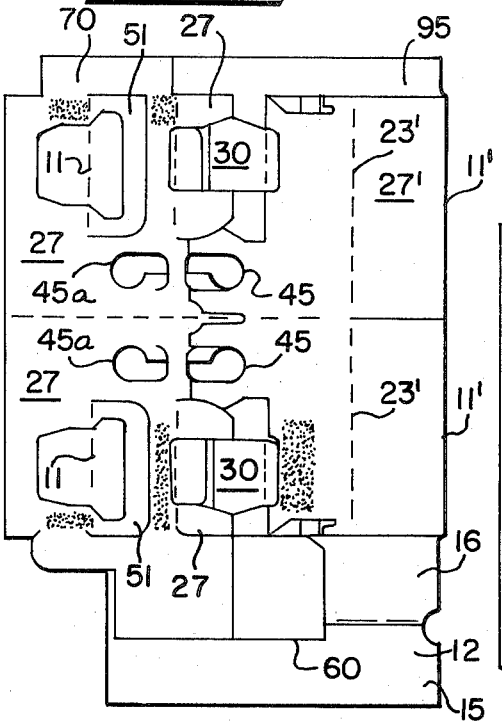
Figure 12:
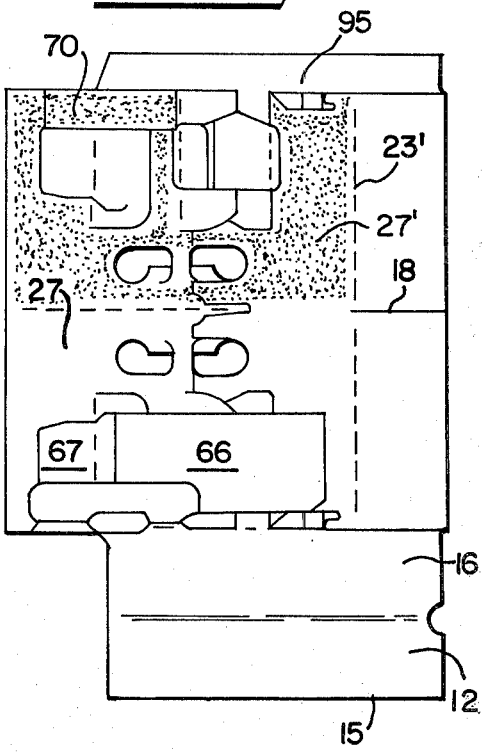
Figure 13:
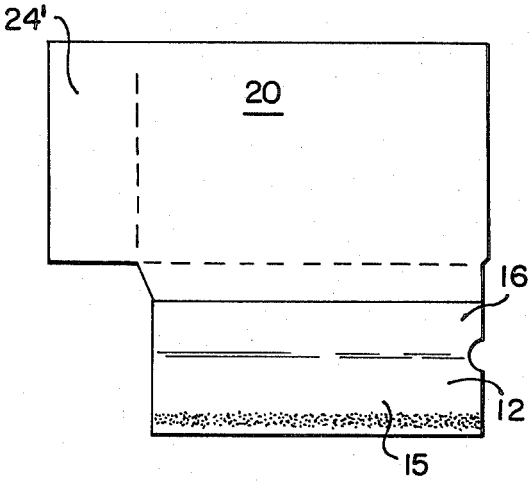
FIG. 13 is a front view of the folded carrier except for the last or final folding step.

The handle cover panel 121, which is formed between the cutting lines 118, 118 and 122, 122, is divided into two approximately half sections by a longitudinally extending score line 155 which is offset a short distance from the line a—a in the direction of the side edge of the blank and small hand hole reinforcing flaps 156 are formed by cutting at the ends and scoring on parallel, longitudinal lines 157. The handle panel 121 remains attached to the one longitudinal partition panel 127 at the end forming score line 158 and is cut free of the other longitudinal panel 127 on the line 160. A transversely extending cutting line 161 defines the other end of the handle panel 121 so that its length corresponds to the length of the side wall panels 120. The blank material between the cutting line 161, the cutting lines 118, 122 and 162 is punched out as waste in forming the blank of the carrier. Likewise, small waste portions result from the cutting lines 129, 129' and 130, 130' so as to provide a hand hole in the center partition structure. The blank 110 is folded and adhesive applied in a similar sequence of steps as described with reference to FIGS. 6 to 10 in the preceeding embodiment. In FIG. 17 the subsequent folding of the panels into engagement with side walls 120 and 124, similar to the configuration of FIG. 11, is illustrated. The carton is then set up in the manner previously described.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode to contemplated for carrying out this invention, but that the invention will include all embodiments falling within the scope of the appended claims.

What is claimed is:

1. A multi-cell article carrier for bottles, or the like, which is formed from a single blank of foldable sheet material and which includes, when erected, a bottom wall, side and end walls upstanding from the bottom wall, said end walls being connected on vertical hinge lines to said sidewalls, a multi-panel, longitudinal partition and handle forming structure upstanding from the bottom wall and having a partition forming portion and a handle forming portion which multi-panel structure is hingedly connected at opposite ends to the end walls on vertical hinge lines at the center of said end walls and divides the carrier into twin compartments, and double panel cross partitions extending in longitudinally spaced relation at opposite sides of said partition forming portion of said multi-panel structure which double panel cross partitions divide each of said compartments into a multiplicity of upwardly opening cells, said cross partitions being hingedly connected to certain of the panel members in the multi-panel longitudinal partition and handle forming structure and being secured in cross partition forming relation to oppositely disposed sidewalls, the two panels forming each of said double panel cross partitions being integrally hinged about a vertical hinge connection, said vertical hinge connection of some of said two panels extending along a vertical hinge line which is disposed on the outer side of the vertical center line of the associated double panel cross partition with portions of said side panels adjacent the hinge line being folded upon each other in face to face relation, said vertical hinge connection of others of said double panels extending along a vertical hinge line which is disposed on the inner side of the vertical centerline of the associated double panel cross partition with portions of said other panels adjacent the hinge line being also folded upon each other in face to face relation.

2. A multi-cell article carrier, as set forth in claim 1, wherein said cross partition members have a double thickness of material in the bottle contact area thereof which is located intermediate the longitudinal partition and handle structure and the associated sidewall and which double thickness of material is in the area which contacts the bottles.

3. A multi-cell article carrier, as set forth in claim 2, wherein the double thickness of material is derived from a portion of a panel member in said multi-panel structure, which double thickness of material is hinged from an edge of said cross partition member and which includes a glue tab hinged thereto on a vertical hinge line and secured to the associated sidewall.

4. The multi-cell article carrier, as set forth in claim 1, wherein said longitudinal partition and handle forming structure has an upper handle forming portion which is situated beneath the level of the top most edges of said side and end walls.

5. The multi-cell article carrier, as set forth in claim 1 wherein at least some of said cross partition members have a panel hingedly connected thereto folded to form a double thickness of material along at least a portion of the length of said multi-panel longitudinal partition members.

6. The multi-cell article carrier, as set forth in claim 5, wherein at least others of said cross partition members have another panel hingedly connected thereto folded to form a double thickness.

7. A multi-cell article carrier, as set forth in claim 1, wherein said longitudinal partition and handle forming structure has an upper handle forming portion which extends above the level of the top most edges of said side and end walls.

8. The multi-cell article carrier, as set forth in claim 1, wherein said some double panel cross partitions comprise at least four respective double panels and said other double panel cross partitions comprise at least two respective double panels.

9. An article carrier blank of paperboard or like material which is cut and scored for fabricating a cellular article carrier, said blank being generally rectangular and being divided by longitudinal and transversely extending scoring and cutting lines so as to provide a pair of sidewall forming panels and three panels of substantially equal width at one end of said sidewall panels which are divided by longitudinally spaced parallel score lines to form an end wall panel, a longitudinal partition panel and one cross partition forming panel at the end thereof, and said blank further forming at least four panels at the opposite end of said sidewall panels, to form an endwall panel, a longitudinal partition panel and at least two cross partition panels, each of said cross partition panels being subdivided by transverse cutting and scoring lines into hinged panel portions which are adapted to fold upon each other about a score line parallel with the score line which connects said cross partition panel with the associated longitudinal partition panel to form double panel cross partitions, said transverse cutting and scoring lines about which said panel portions are hinged for folding upon each other being hinged such that upon erection at least some of said double panel cross partitions will be formed from folding along a vertical hinge line which is disposed on the outer side of a vertical center line of the associated double panel cross partition while others of said double panels will be formed upon folding about a vertical hinge line which is disposed on the inner side of the vertical center line of the associated double panel cross partition.

10. An article carrier blank of paperboard or like material which is cut and scored for fabricating a cellular article carrier, said blank being generally rectangular and being divided by longitudinal and transversely extending scoring and cutting lines so as to provide a pair of sidewall forming panels and three panels of substantially equal width at one end of said sidewall panels which are divided by longitudinally spaced parallel score lines to form an end wall panel, a longitudinal partition panel and one cross partition forming panel at the end thereof, said blank further forming at least four panels at the opposite end of said side wall panels wherein a pair of longitudinal partition reinforcing panels extend from the bottom forming edge of said at least four panels at one end of one of the sidewall forming panels which reinforcing panels are cut and scored so as to fold upon each other and also fold about the bottom forming edge of the associated longitudinal partition panel to form an end wall panel, a longitudinal partition panel and at least two cross partition panels, each of cross partition panels being subdivided by transverse cutting and scoring lines into hinged panel portions which are adapted to fold upon each other about a score line parallel with the score line which connects said cross partition panel with the associated longitudinal partition panel.

* * * * *